US010281212B2

(12) United States Patent
Yanagi et al.

(10) Patent No.: US 10,281,212 B2
(45) Date of Patent: May 7, 2019

(54) FIRED PRECAST BLOCK

(71) Applicant: TYK CORPORATION, Minato-ku (JP)

(72) Inventors: Kenji Yanagi, Tajimi (JP); Eiji Kozawa, Tajimi (JP)

(73) Assignee: TYK CORPORATION, Minato-ku (JP)

( * ) Notice: Subject to any disclaimer, the term of this patent is extended or adjusted under 35 U.S.C. 154(b) by 199 days.

(21) Appl. No.: 15/161,629

(22) Filed: May 23, 2016

(65) Prior Publication Data

US 2017/0205144 A1 Jul. 20, 2017

(30) Foreign Application Priority Data

Jan. 18, 2016 (JP) ..... 2016-007069

(51) Int. Cl.
*F27D 1/00* (2006.01)
*F27D 1/04* (2006.01)
(Continued)

(52) U.S. Cl.
CPC ..... *F27D 1/0006* (2013.01); *F27D 1/004* (2013.01); *F27D 1/04* (2013.01); *F27D 1/063* (2013.01); *F27D 3/145* (2013.01)

(58) Field of Classification Search
CPC ..... F27D 1/0006; F27D 1/004; F27D 1/04; F27D 1/063; F27D 3/145
(Continued)

(56) References Cited

U.S. PATENT DOCUMENTS 308,577 A * 11/1884 Richards ..... C21B 7/10 432/248
6,428,743 B1 8/2002 Stoupis et al.
(Continued)

FOREIGN PATENT DOCUMENTS

CN 201016558 Y 2/2008
CN 101672576 * 3/2010 ..... F27D 1/0006
(Continued)

OTHER PUBLICATIONS

CN101672576, Cong et al., Furnace hearth of maintaining room of aluminum alloy melting frunace built by combining castin materials with precast bricks, Mar. 17, 2010, pp. 1-4.*
(Continued)

*Primary Examiner* — Jessee R Roe
*Assistant Examiner* — Michael Aboagye
(74) *Attorney, Agent, or Firm* — Oblon, McClelland, Maier & Neustadt LLP

(57) ABSTRACT

A fired precast block prevents itself from dropping off early due to corrosion and increases service life of a blast furnace runner, etc. when used in a very vulnerable portion of the blast furnace runner, etc., and can be produced at low costs. The fired precast block has an upper surface to contact molten metal or slag, a lower surface opposing the upper surface, and a plurality of side surface. The fired precast block is used by being embedded in a castable in such a manner that the upper surface is exposed from the castable and the lower surface and the plurality of side surfaces contact the castable. Each side surface of at least one opposing pair of side surfaces includes a planar portion and an uneven portion. The uneven portion has at least one groove-shaped concave portion.

6 Claims, 2 Drawing Sheets

(51) Int. Cl.
*F27D 1/06* (2006.01)
*F27D 3/14* (2006.01)

(58) Field of Classification Search
USPC ..... 266/283, 196, 231; 264/273, 274, 275; 222/594
See application file for complete search history.

(56) References Cited

U.S. PATENT DOCUMENTS

| | | | | |
|---|---|---|---|---|
| 7,128,247 | B2 * | 10/2006 | Retschnig | B22D 11/103 222/594 |
| 9,248,497 | B2 * | 2/2016 | Vincent | F27D 3/145 |
| 2015/0377554 | A1 * | 12/2015 | Smith | C21B 7/10 266/193 |

FOREIGN PATENT DOCUMENTS

| | | | |
|---|---|---|---|
| CN | 101672576 | A | 3/2010 |
| CN | 201809364 | U | 4/2011 |
| CN | 201850282 | U | 6/2011 |
| DE | 23 46 687 | A1 | 3/1975 |
| JP | 55-58644 | U | 4/1980 |
| JP | 60-140088 | A | 7/1985 |
| JP | 2-166207 | A | 6/1990 |
| JP | 7-6693 | U | 1/1995 |
| JP | 9-95708 | | 4/1997 |
| JP | 2012-149863 | A | 8/2012 |

OTHER PUBLICATIONS

Extended European Search Report dated Jun. 8, 2017 in Patent Application No. 16171947.1.
Combined Office Action and Search Report dated May 25, 2017 in Taiwan Patent Application No. 105116559 (with English translation of categories of cited documents).
Japanese Notification of Reasons for Refusal dated Jul. 3, 2018 in Patent Application No. 2016-007069.

* cited by examiner

FIRED PRECAST BLOCK

BACKGROUND OF THE INVENTION

Field of the Invention

The present invention relates to a fired precast block to be used as part of an inner lining layer of a blast furnace runner, a blast furnace, etc.

Description of the Related Art

Blast furnace runners are equipment for separating hot liquid (molten metal and slag) drained from a tap hole of a blast furnace and having high temperatures of 1,450 to 1,550 deg. C. into molten metal and molten slag by utilizing a difference in specific gravity, and transporting the molten metal and the molten slag to subsequent transport vessels or other facilities, respectively. A refractory material (a wear lining) of portions of a blast furnace runner to contact the molten metal or slag is easily worn away by molten slag. Therefore, it is demanded that the wear lining has high heat resistance and corrosion resistance.

In general, a blast furnace runner is produced by pouring an unshaped material (a castable) comprising alumina, magnesium spinel, silicon carbide, etc. as aggregate in formwork and thus forming a passage for molten metal or slag. A wear lining of the blast furnace runner is supported by an iron shell constituting an outer frame by way of refractories such as alumina-silicon carbide bricks and a heat-insulating castable.

Of the hot liquid, molten metal is metal in a liquid state having iron as a main component, and molten slag is oxides such as $SiO_2$, $Al_2O_3$ and CaO in a liquid state. The molten metal and the molten slag are different in specific gravity and the molten metal has a greater specific gravity than the molten slag. Therefore, the molten metal descends to and flows at a bottom of a blast furnace runner, while the molten slag floats on top of the molten metal. It should be noted that an interface between the molten metal and the molten slag is called metal line and an interface between the molten slag and the air is called slag line. A portion of a side wall of a blast furnace runner to contact the metal line is called a metal line portion, and a portion of a side wall of a blast furnace runner to contact the slag line is called a slag line portion.

A wear lining is susceptible to cracking and local damages because the wear lining is brought in contact with high-temperature molten metal or slag and subjected to repetition of heating and cooling. Particularly severe wear is observed on the wear lining at a portion of a side wall to contact a boundary surface of molten slag or metal, such as the abovementioned slag line portion and the abovementioned metal line portion, because local flows of the molten slag or metal occur. If wear of the wear lining increases and thus thickness of the remaining side wall decreases, there arises a risk that molten metal or slag may leak out. Leak of molten metal or slag not only causes trouble to attached facilities of the blast furnace but also exerts adverse effect on operation safety and surrounding environment. Therefore, the wear lining of the side wall needs to be repaired at regular intervals.

However, wear of the wear lining is particularly severe at the slag line portion and the metal line portion as mentioned above. That is to say, wear occurs not uniformly over the entire wear lining but locally. If the wear lining at other portions of side walls is in good condition but the wear lining remaining at the slag line portion or the metal line portion locally decreases in thickness, repair is needed in order to prevent molten metal or slag from leaking out.

Therefore, careful inspection and repair of the wear lining are frequently executed in practical operation.

In view of these circumstances, Patent Document 1 discloses that in a blast furnace runner having an inner lining layer formed by casting or spraying an unshaped refractory material, a plurality of precast refractory blocks are combined and placed at a portion of a side wall to be heavily attacked by molten metal or slag flows from a tap hole and thus need to have high fire resistance. This technique aims to reduce wear of a very vulnerable portion of the inner lining layer of the blast furnace runner and allow the entire blast furnace runner to be uniformly worn away, and thus improve durability of the blast furnace runner.

However, since a plurality of precast refractory blocks are combined and placed, the technique of Patent Document 1 requires precast refractory blocks of a plurality of kinds of shapes. In addition, the technique of Patent Document 1 has a risk that the precast refractory blocks may drop off early due to wear of the unshaped refractory material covering peripheries of the combined and placed precast refractory blocks. Therefore, the technique of Patent Document 1 does not fully solve problems such as an increase in production costs caused by the need of precast refractory blocks of a plurality of kinds of shapes and a decrease in service life caused by early drop off of the precast refractory blocks.

CITATION LIST

Patent Literature

[PTL 1] Japanese Unexamined Patent Application Publication No. H09-95708

SUMMARY OF THE INVENTION

Technical Problem

The present invention has been made in view of the above circumstances. It is an object of the present invention to provide a fired precast block capable of preventing itself from dropping off early due to corrosion by molten metal or slag, increasing service life of a blast furnace runner, etc. and reducing production costs.

Solution to Problem

In order to solve the abovementioned problems, a fired precast block of the present invention comprises an upper surface to contact molten metal or slag, a lower surface opposing the upper surface, and a plurality of side surfaces and is used by being embedded in a castable in such a manner that the upper surface is exposed from the castable and the lower surface and the plurality of side surfaces contact the castable, wherein each side surface of at least one opposing pair of of the plurality of side surfaces includes a planar portion and an uneven portion, and the uneven portion has at least one groove-shaped concave portion.

In the present invention, each side surface of at least one opposing pair of side surfaces has an uneven portion, and the uneven portion has at least one groove-shaped concave portion. When the fired precast block of the present invention is applied, for example, to a side wall of a blast furnace runner, the fired precast block is placed in such a manner that an upper surface is located on a molten metal or slag side and a lower surface is located on an iron shell side, and side surfaces and the lower surface are buried in a wear lining.

Even if the wear lining covering peripheries of side surfaces of the fired precast block is worn away early in such a case, the groove-shaped concave portion of the present invention can grasp the remaining wear lining. Therefore, the fired precast block of the present invention can suppress itself from dropping off.

Besides, since the present invention is a fired precast block, its resistance to fire is good. Owing to being fired beforehand, microstructure of the precast block increases in strength and is hardly affected by temperature of molten metal or slag. Therefore, the fired precast block of the present invention improves in resistance to attacks of molten metal and slag and thermal shock in receiving the tapped molten metal and slag. Furthermore, precast blocks are much more inexpensive than refractory bricks, and have higher degree of freedom in shape.

Advantageous Effects of the Invention

As mentioned above, the fired precast block of the present invention can effectively protect a very vulnerable metal line or slag line portion of a side wall of a blast furnace runner, etc. from being worn away. In addition, owing to having means for preventing drop off on at least one opposing pair of side surfaces thereof, the fired precast block of the present invention can prevent itself from dropping off early due to corrosion. Furthermore, since the present invention is a fired precast block, the present invention is more inexpensive than a refractory brick.

Thus, the fired precast block of the present invention can prevent itself from dropping off early, increase service life of a blast furnace runner, etc. and reduce production costs.

DESCRIPTION OF PREFERRED EMBODIMENTS

Hereinafter, preferred embodiments of the present invention will be described with reference to the drawings. In these drawings, the same numerals and letters of reference denote the same parts. Material, shape, and relative arrangement of component parts found in the following description of the preferred embodiments are illustrative only and are not intended to limit the scope of the present invention. Left, right, up, down, forward, and backward in the description of the present invention indicate those shown in FIG. 1.

Figure 1:
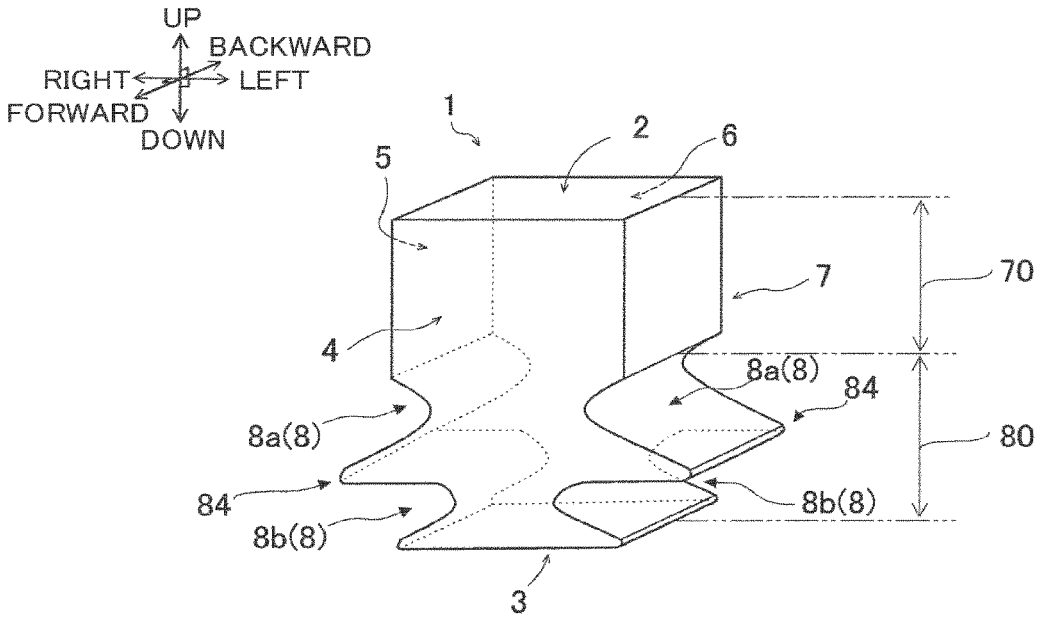
FIG. 1 is a perspective diagram of the present invention.
Figure 2:
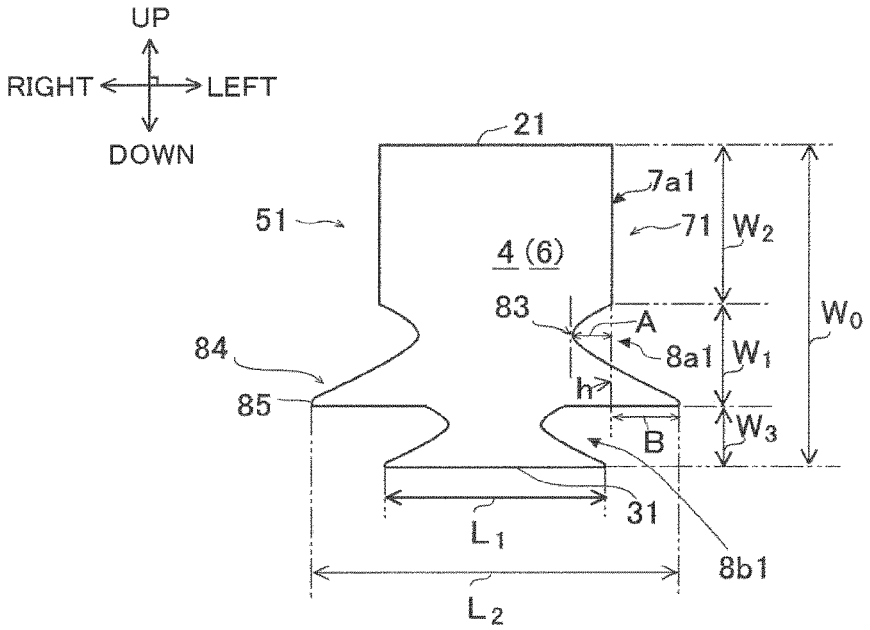
FIG. 2 is an elevational view of the present invention.
Figure 3:
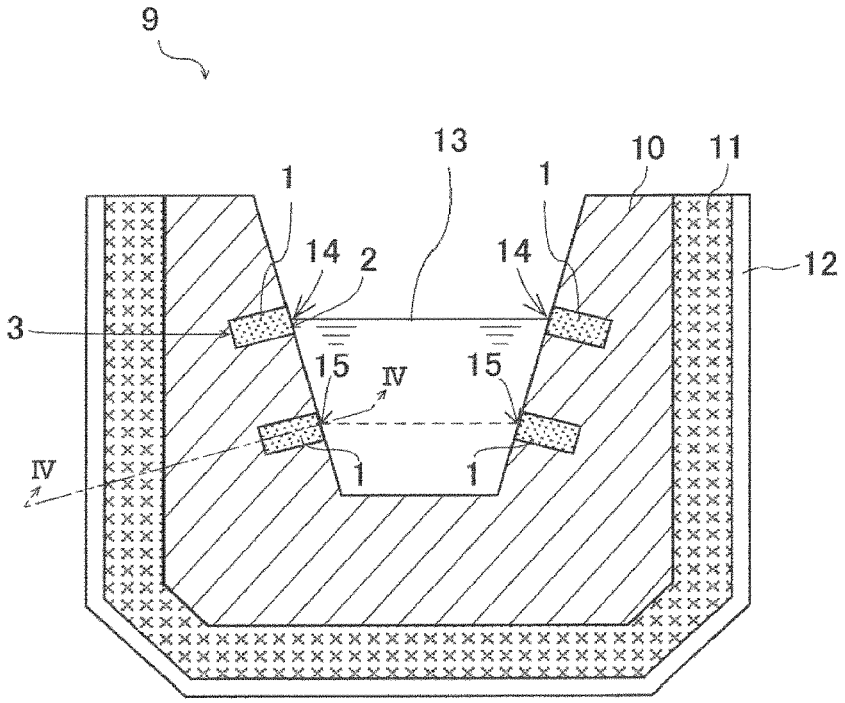
FIG. 3 is a cross-sectional view schematically showing the present invention applied to a blast furnace runner.
Figure 4:
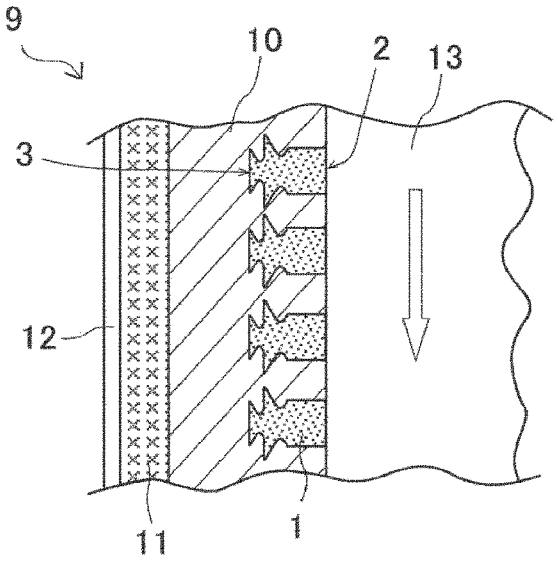
FIG. 4 is a cross-sectional view schematically showing a cross section cut along the line IV-IV in FIG. 3.

FIG. 1 is a perspective view schematically showing a fired precast block of the present invention. FIG. 2 is an elevation as viewed from a first side surface or a third side surface. FIGS. 3 and 4 are views showing the present invention applied to particularly vulnerable metal line and slag line portions of side walls of a blast furnace runner. FIG. 3 is a schematic view showing a cross section perpendicular to a direction of molten metal and slag flow through a passage in the blast furnace runner. FIG. 4 is a schematic view showing a cross section in parallel to the direction of the molten metal and slag flow.

Example 1

Structure

A fired precast block 1 of Example 1 will be discussed with reference to FIGS. 1 and 2. The fired precast block 1 is a precast block of a roughly hexahedral shape having an upper surface 2, a lower surface 3, and four side surfaces.

The fired precast block 1 of Example 1 is employed, for example, in a side wall of a molten metal and slag passage of a blast furnace runner, and used by being embedded in a castable constituting part of the side wall. Specifically, the fired precast block 1 is embedded in the castable in such a manner that the upper surface 2 is exposed from the castable and the lower surface 3 and the four side surfaces contact the castable. That is to say, the fired precast block 1 is used in a side wall of a blast furnace runner in such a manner that the upper surface 2 serves as a surface to contact molten metal or slag.

The four side surfaces comprise a first side surface 4, a second side surface 5, a third side surface 6 and a fourth side surface 7. The first side surface 4 and the third side surface 6 oppose each other and the second side surface 5 and the fourth side surface 7 oppose each other. In Example 1, the first side surface 4 and the third side surface 6 have the same shape, and the second side surface 5 and the fourth side surface 7 have the same shape.

As shown in FIG. 1, each of the second side surface 5 and the fourth side surface 7 includes a planar portion 70 and an uneven portion 80. Since the second side surface 5 and the fourth side surface 7 have the same shape, hereinafter the fourth side surface 7 will be discussed as an example.

In the fourth side surface 7, as shown in FIGS. 1 and 2, the planar portion 70 is located at an upper position close to the upper surface 2, and the uneven portion 80 is located at a lower position close to the lower surface 3. The planar portion 70 and the uneven portion 80 are continuous to each other. The uneven portion 80 has at least one concave portion 8 and at least one convex portion 84. In Example 1, the number of the at least one concave portion 8 is two, and the number of the at least one convex portion 84 is one.

As shown in FIGS. 1 and 2, the two concave portions 8 are depressed from the planar portion 70 in the right direction and comprise an upper concave portion 8*a* and a lower concave portion 8*b*. The upper concave portion 8*a* is located above the lower concave portion 8*b*, that is, at a position close to the upper surface 2.

The convex portion 84 protrudes from the planar portion 70 in the left direction, and is located between the upper concave portion 8*a* and the lower concave portion 8*b*. The convex portion 84 has a peak portion 85 which protrudes most in the left direction.

As shown in FIG. 1, each of the upper concave portion 8*a* and the lower concave portion 8*b* has a shape of a groove-shaped concave penetrating from the first side surface 4 to the third side surface 6, which are surfaces adjacent to the fourth side surface 7 having the concave portions 8. Although a surface forming the upper concave portion 8*a* and the lower concave portion 8*b* is curved in Example 1 as shown in FIG. 1, shape of the surface is not limited to this and can be bent sharply.

Position and shape of the concave portions 8 will be discussed. FIG. 2 is an elevation as viewed from the first side surface 4 or the third side surface 6. The first side surface 4 or the third side surface 6 has an upper surface side 21 as a side constituting part of the upper surface 2, a lower surface side 31 as a side constituting part of the lower surface 3, a second side surface side 51 as a side constituting part of the second side surface 5, and a fourth side surface side 71 as a side constituting part of the fourth side surface 7. As mentioned above, the second side surface 5 and the fourth side surface 7 have the same shape in Example 1. Therefore, the second side surface side 51 and the fourth side surface side 71 are symmetric about a line and have similar shapes. Hereinafter, the fourth side surface side 71 will be discussed as an example.

As shown in FIG. 2, the fourth side surface side 71 comprises a vertical side 7*a*1 forming the planar portion 70, an upper arcuate side 8*a*1 forming the upper concave portion 8*a*, and a lower arcuate side 8*b*1 forming the lower concave portion 8*b*.

As shown in FIG. 2, it is assumed that in the fourth side surface side 71, $W_1$ is a straight-line length of a portion constituting the upper arcuate side 8*a*1, $W_3$ is a straight-line length of a portion constituting the lower arcuate side 8*b*1, $W_2$ is a straight-line length of the vertical side 7*a*1, and $W_0$ is a straight-line length from the upper surface side 21 to the lower surface side 31. "A straight-line length" mentioned herein means a length of each portion of the side in the up and down directions shown in FIG. 2, and the equation $W_0=W_2+W_1+W_3$ is satisfied.

More specifically, in Example 1, $W_2$ is a length from the upper surface side 21 to a boundary between the vertical side 7*a*1 and the upper arcuate side 8*a*1, $W_1$ is a length from the boundary between the vertical side 7*a*1 and the upper arcuate side 8*a*1 to a peak portion 85, and $W_3$ is a length from the peak portion 85 to the lower surface side 31.

Method for producing the fired precast block 1 of Example 1 is not particularly limited, and an example of the production method is shown below. One or more refractory raw materials selected from silica-alumina, alumina, magnesia, magnesia-calcia, spinel, zircon, zirconia, etc. are used as main aggregate. One or more kinds of materials selected from carbon, carbides, nitrides, borides, chromium oxide, silicon carbide, ultrafine alumina powder, clay, ultrafine refractory powder, fibers, metal powder, etc. are mixed with the main aggregate, if necessary. A binder, a dispersant, and water are added and those are well kneaded and cast in a mold.

After being cast, a molding is cured and dried. Although method for producing a conventional precast block finishes with this step, a step of firing the molding is carried out in Example 1. Desired firing temperature is 800 to 1,600 deg. C.

The binder and the dispersant used in Example 1 are the same as those used for production of conventional precast blocks. Desired examples of the binder are one or more selected from colloidal silica, alumina sol, alumina cement, portland cement, light buried magnesia, hydraulic alumina, sodium phosphate, phosphate glass, sodium silicate, orthophosphoric acid, phenol resin, pitch, etc. Desired examples of the dispersant are one or more materials selected from alkali metal phosphates, alkali metal polyphosphates, alkali metal polyphosphoric acid and alkali metal carboxylate.

Although not limited to the above-mentioned, the main aggregate of the fired precast block is desirably a combination of alumina and spinel or a combination of alumina and zircon. It is also desired that the raw material mixture has a high content of silicon carbide. An alumina-spinel precast block has a high corrosion resistance because slag components such as FeO and $MnO_2$ form a solid solution with spinel and slag are thus prevented from penetration. An alumina-zircon precast block has an improved corrosion resistance because $SiO_2$ generated by dissociation of zircon is present in a high-viscosity liquid phase and prevents slag from penetration. Furthermore, silicon carbide hardly gets wet with molten slag and has good fire resistance and volume stability, and is more inexpensive than other carbides, so addition of silicon carbide is efficient in reduction of production costs.

Moreover, a fired precast block is employed in Example 1. In general, a refractory brick is produced by preparing a powdery material and filling and compressing the powdery material in a mold under high pressure, and then firing an obtained green compact at elevated temperatures to sinter the green compact. The mold for forming a green compact is very expensive because high pressure is applied to the hard powdery material. In addition, the firing at elevated temperatures requires much cost. However, the refractory brick has a high density and exhibits high performance such as high corrosion resistance. Therefore, such refractory bricks are often used in a portion which particularly requires heat resistance and corrosion resistance.

On the other hand, a castable, which is an unshaped refractory, is suitably used in a portion where bricks are hard to be laid or a portion which needs some measures for heat insulation or corrosion resistance. Generally, a castable is applied by kneading raw materials of the castable with water and casting the kneaded material or spraying raw materials of the castable with water on a site. The castable is fired into a dense layer at high temperatures under actual operating environment.

In contrast to this, fired precast blocks are produced by kneading raw materials with water, casting the kneaded material in a mold and firing an obtained molding in a factory. In a case of on-site production, the amount of water to be added and a process for kneading raw materials of the castable need to be subtly adjusted to temperature and humidity and these adjustments often need to be done based on experience and professional intuition of workers. In some cases, a variation is generated in accuracy in construction. In a factory, however, production of fired precast blocks are carried out under controlled temperature and humidity. Therefore, products can fully exhibit material characteristics and have little variation in performance. Formwork for fired precast blocks is inexpensive because the formwork does not need high pressure application unlike those for refractory bricks, and has a high degree of freedom in shape. Therefore, fire precast blocks can be produced at much lower costs than refractory bricks.

Advantageous Effects

Advantageous effects of the fired precast block 1 of Example 1 will be hereinafter described. As mentioned before, the second side surface 5 and the fourth side surface 7 have the same shape in Example 1. Therefore, the fourth side surface 7 will be discussed as an example but the second side surface 5 exhibits similar advantageous effects.

The fired precast block 1 of Example 1 is used by being embedded in a castable such as a wear lining of a blast furnace runner. In this case, the castable, which has a lower fire resistance to the fired precast block 1 of Example 1, is worn away by molten metal or slag earlier than the fired precast block 1 of Example 1. Therefore, there is a risk that the fired precast block 1 may drop off due to corrosion of the castable surrounding the fired precast block 1. However, the fourth side surface 7 of the fired precast block 1 of Example 1 has two groove-shaped concave portions 8 (the upper concave portion 8*a* and the lower concave portion 8*b*). The groove-shaped concave portions 8 grasp the remaining castable and suppresses the fired precast block 1 from dropping off.

As shown in FIGS. 1 and 2, the uneven portion 80 is more distant from the upper surface 2 than the planar portion 70 and, desirably, the uneven portion 80 having the concave portions 8 (the upper concave portion 8*a* and the lower concave portion 8*b*) occupies a greater ratio in the fourth side surface 7 than the planar portion 70. That is to say, as shown in FIG. 2, desirably, $W_1+W_3/W_0$ is not less than ½ and not more than ⅘. More desirably, $W_1+W_3/W_0$ is not less than ½ and not more than ⅔. In this case, desirably, the straight-line length $W_3$ of the lower concave portion 8*b* of the uneven portion 80 satisfies $\frac{1}{5} W_0<W_3<\frac{1}{2} W_0$.

Upon putting the ratio of the uneven portion 80 in the fourth side surface 7 within the abovementioned range, the concave portions (the upper concave portion 8*a* and the lower concave portion 8*b*) can more effectively grasp the remaining castable. That is to say, upon used in a side wall of a blast furnace runner, etc., the fired precast block 1 of Example 1 contributes to an increase in service life of the blast furnace runner, etc.

Moreover, when A is a length from a two-dot chain line h extended from the vertical side 7*a*1 toward the lower surface side 31 to a deepest portion 83 of the upper arcuate side 8*a*1, and B is a length from the two-dot chain line h to the peak portion 85 of the convex portion 84 as shown in FIG. 2, desirably, A is smaller than B. That is to say, desirably, A/B is not more than ⅘ and more desirably A/B is not less than ⅔ and not more than ¾. Upon putting a relation between the deepest portion 83 of the upper arcuate side 8*a*1 and the peak portion 85 of the convex portion 84, i.e., a relation between the upper concave portion 8*a* and the convex portion 84 within the above ratio range, the upper concave portion 8*a* can more effectively grasp the remaining castable and the convex portion 84 can effectively exert an anchoring effect on the remaining castable.

Long use of a blast furnace runner may increase wear of the wear lining which forms a molten metal or slag passage and cause molten metal or slag to penetrate into the castable surrounding the convex portion 84 of the fired precast block 1 embedded in the wear lining. In this case, a portion of the castable located above the convex portion 84 is worn away by the molten metal or slag and not left at all. Therefore, the upper concave portion 8*a* cannot effectively grasp the castable, and the convex portion 84 cannot exert the anchoring effect.

However, the fired precast block 1 of Example 1 has the lower concave portion 8*b*. That is to say, there is at least one groove-shaped concave portion which is more distant from the upper surface 2 than the convex portion 84. Accordingly, even if the fired precast block 1 falls in the abovementioned situation, the lower concave portion 8*b* can grasp the remaining castable and the fired precast block 1 suppresses itself from dropping off from the wear lining.

Moreover, when $L_1$ is a straight-line length of the lower surface side 31 and $L_2$ is a straight-line length from the peak portion 85 of the convex portion 84 provided on the second side surface 5 to the peak portion 85 of the convex portion 84 provided on the fourth side surface 7 as shown in FIG. 2, desirably, $L_1$ is smaller than $L_2$. That is to say, as shown in FIG. 1, desirably, the convex portion 84 provided on the uneven portion 80 protrudes in the right or left direction from the planar portion 70.

Owing to the abovementioned structure, the convex portion 84 prevents penetration of molten metal or slag. That is to say, because the convex portion 84 provided on the uneven portion 80 protrudes in the right or left direction from the planar portion 70, the castable located below the convex portions 80 is less likely to be worn away by molten metal or slag. Therefore, the lower concave portion 8*b* can more effectively grasp the remaining castable and suppress the fired precast block 1 from dropping off. Hence, use of the fired precast block 1 of Example 1 in a blast furnace runner, etc. contributes to an increase in service life of the blast furnace runner, etc.

Example 2

Example 2 is an example of a plurality of fired precast blocks of the present invention applied to a blast furnace runner. Example 2 will be discussed with reference to FIGS. 3 and 4.

A blast furnace runner 9 shown in FIG. 3 comprises a wear lining 10 to contact molten metal and slag 13, an iron shell 12 constituting an outer frame of the blast furnace runner 9, and a heat-insulating castable 11 provided between the wear lining 10 and the iron shell 12. The blast furnace runner 9 can be an ordinary blast furnace runner and is not limited to this.

In the blast furnace runner 9, as shown in FIG. 3, a plurality of fired precast blocks 1 of Example 2 are placed at particularly vulnerable slag line portions 14 and metal line portions 15 of the wear lining 10 forming a molten metal and slag passage. The number of fired precast blocks 1 placed is not particularly limited and can be appropriately changed in accordance with degree and area of estimated damage.

As shown in FIG. 4, each of the fired precast blocks 1 of Example 2 is embedded in the wear lining 10. An upper surface 2 faces molten metal or slag and a lower surface 3 faces the iron shell 12. The upper surface 2 is exposed from the wear lining 10 and contacts molten metal or slag. A second side surface 5 and a fourth side surface 7 which oppose each other and have groove-shaped concave portions 8 are placed in a perpendicular direction to a flow direction of the molten metal and slag 13. The outlined arrow shown in FIG. 4 indicates the flow direction of the molten metal and slag 13.

Upon placed in the wear lining 10 which constitutes part of side walls of a molten metal and slag passage of the blast furnace runner 9, the fired precast blocks 1 of Example 2 can protect the particularly vulnerable slag line portions 14 and metal line portions 15 from being worn away by molten metal or slag and increase service life of the blast furnace runner 9.

However, portions of the wear lining 10 located between the fired precast blocks 1 of Example 2 may be worn away early. In such a case, there is a possibility that the molten metal or slag may enter from a worn portion of the wear lining 10 and the fired precast blocks 1 may drop off early from normal position.

In the fired precast blocks 1 of Example 2, each of side surfaces perpendicular to the flow direction of the molten metal and slag 13 (a second side surface 5 and a fourth side surface 8) has groove-shaped concave portions 8 (an upper concave portion 8*a* and a lower concave portion 8*b*) as means for preventing drop off. Therefore, even if portions of the wear lining 10 surrounding the fired precast blocks 1 are worn away by the molten metal and slag 13, the concave portions 8 (the upper concave portion 8*a* and the lower concave portion 8*b*) can grasp the remaining wear lining 10 and thus effectively prevent the fired precast blocks 1 from dropping off early. In addition, the fired precast blocks 1 of Example 2 exhibit similar advantageous effects to those of Example 1 described above.

Other Examples

Furthermore, although the uneven portion 80 of each side surface of the opposing pair of side surfaces of the fired precast block 1 of Example 1 comprises two concave portions 8, the number of concave portions 8 can be one or three or more in another example of the present invention.

Moreover, although the uneven portion 80 is provided on one opposing pair of side surfaces of the fired precast block 1 of Example 1, an uneven portion 80 can be provided on one or more of the other side surfaces.

In addition, although the side surfaces having the uneven portions 80 are placed in a perpendicular direction to the flow direction of molten metal and slag in each of the fired precast blocks 1 of Example 2, instead of these side surfaces, side surfaces having uneven portions 80 can be placed in parallel to the flow direction of molten metal and slag. Such a fired precast block can also exhibit the advantageous effects of the present invention.

What is claimed is:

1. A fired precast block for a blast furnace comprising:

an upper surface to contact molten metal or slag, a lower surface opposing the upper surface, and a plurality of side surfaces and used by being embedded in a castable in such a manner that the upper surface is exposed from the castable and the lower surface and the plurality of side surfaces contact the castable, wherein each side surface of at least one opposing pair of the plurality of side surfaces includes a planar portion and an uneven portion, the uneven portion has at least one groove-shaped concave portion, the uneven portion has a convex portion protruding from the planar portion, and the at least one groove-shaped concave portion is more distant from the upper surface than the convex portion.

2. The fired precast block according to claim 1, wherein the at least one groove-shaped concave portion penetrates two of the plurality of side surfaces adjacent to a side surface having the at least one groove-shaped concave portion.

3. The fired precast block according to claim 1, wherein, in each side surface of the at least one opposing pair of the plurality of side surfaces having the uneven portion, the uneven portion is more distant from the upper surface than the planar portion and a straight-line length of the uneven portion is not less than ½ and not more than ⅘ of a straight-line length from the upper surface to the lower surface.

4. The fired precast block according to claim 1, wherein the fired precast block is embedded in the castable in such a manner that the upper surface is exposed from the castable and the lower surface and the plurality of side surfaces contact the castable.

5. The fired precast block according to claim 2, wherein the fired precast block is embedded in the castable in such a manner that the upper surface is exposed from the castable and the lower surface and the plurality of side surfaces contact the castable.

6. The fired precast block according to claim 3, wherein the fired precast block is embedded in the castable in such a manner that the upper surface is exposed from the castable and the lower surface and the plurality of side surfaces contact the castable.

* * * * *